US007032865B2

(12) United States Patent
Lafreniere

(10) Patent No.: US 7,032,865 B2
(45) Date of Patent: Apr. 25, 2006

(54) RAILWAY INDICATOR DEVICE AND METHOD

(76) Inventor: Rene G. Lafreniere, 305 McKay Avenue, Winnipeg, Manitoba (CA) R2G 0N5

( * ) Notice: Subject to any disclaimer, the term of this patent is extended or adjusted under 35 U.S.C. 154(b) by 0 days.

(21) Appl. No.: 10/839,239

(22) Filed: May 6, 2004

(65) Prior Publication Data

US 2005/0247825 A1 Nov. 10, 2005

(51) Int. Cl.
*G09F 7/00* (2006.01)

(52) U.S. Cl. ..... 246/477; 246/473 R

(58) Field of Classification Search ..... 246/477, 246/127, 473 R, 473.1, 473.2, 479, 482, 246/483, 485, 488; 116/63, 303
See application file for complete search history.

(56) References Cited

U.S. PATENT DOCUMENTS

| | | | | |
|---|---|---|---|---|
| 418,155 A | | 12/1889 | Berry | |
| 606,197 A | | 6/1898 | Dunn | |
| 822,195 A | | 5/1906 | Eaton | |
| 1,002,260 A | * | 9/1911 | Golden | 246/477 |
| 1,271,740 A | * | 7/1918 | McKinney | 116/63 R |
| 1,297,521 A | | 3/1919 | Van Dresar | |
| 2,109,286 A | * | 2/1938 | Cubby | 49/13 |
| 3,806,172 A | * | 4/1974 | Maze | 292/44 |
| 5,097,790 A | * | 3/1992 | Massey | 116/63 P |
| 5,887,667 A | * | 3/1999 | Van Zante et al. | 175/67 |
| 5,905,216 A | | 5/1999 | Davis | |
| 6,386,492 B1 | | 5/2002 | Brown et al. | |

FOREIGN PATENT DOCUMENTS

| | | |
|---|---|---|
| CA | 2265253 | 10/1926 |
| CA | 2011942 | 9/1990 |

* cited by examiner

*Primary Examiner*—Mark T. Le
(74) *Attorney, Agent, or Firm*—Ryan W. Dupuis; Michael R. Williams; Adrian D. Battison

(57) ABSTRACT

A railway indicator device is provided for indicating a condition associated with a particular section of track of a railway. The device includes a post supported in the ground adjacent the railway track which pivotally supports a swing arm thereon for movement between a raised position extending vertically above the post and a lowered position extending horizontally across the railway track spaced above the ground. An indicator panel, for example a blue flag indicator is supported on the free end of the swing arm for pivotal movement therewith relative to the post. The pivoting swing arm permits the indicator panel to be readily retracted or deployed by a single operator while minimizing opportunity for the indicator panel to be lost or damaged as commonly occurs with conventional designs of indicators used on railways.

19 Claims, 6 Drawing Sheets

RAILWAY INDICATOR DEVICE AND METHOD

FIELD OF THE INVENTION

The present invention relates to a device and method of use thereof for providing an indicator in association with a railway track.

BACKGROUND

In the railway industry, blue flags are typically portable devices that clip on or clamp on to the rails of a railway track. These devices are heavy and have a large metal flag attached to them that is troublesome in its conventional design. Blue flags are one example of blue signals used in the railway industry. A blue signal is, by definition, a clearly distinguishable blue flag, blue light or blue tag by day or blue light or blue tag by night. When displayed it signifies that workers are on, under or beneath equipment on the rails of a section of railway track.

Some of the problems associated with conventional blue flag designs are associated with wind forces acting on the flag as the force can be considerable due to the size of the flag, thereby pulling someone off balance or blowing the flag out of someone's hands. Blue flags are often carried long distances to where they are needed. When railroads have tried to make these flags out of plastic to reduce the weight, they tend to break easily. Most portable blue flags are lost, broken or needing repair in a short period of time, making them costly safety items. Some attempts have been made to apply permanent blue flags that lay down in the centre of the tracks. These flags have a post with a hinge attached to a railroad tie and accordingly when needed, the flag is lifted from the centre of the track and locked in place vertically. The problem with these flags is that snow covers them in the winter, low riding locomotives rip them out, snow clearing equipment further damages them and oil and grease from locomotives make them dirty, thus requiring cleaning.

U.S. Pat. No. 418,155 to Berry, U.S. Pat. No. 822,195 to Eaton, U.S. Pat. No. 606,197 to Dunn, U.S. Pat. No. 1,297,521 to Van Dresar, U.S. Pat. No. 5,905,216 to Davis and U.S. Pat. No. 6,386,492 to Brown et al as well as Canadian documents 2,265,253 to Davis and U.S. Pat. No. 2,011,942 to Dean et al disclose numerous variations to indicator devices for use with railways. In each instance however removable flags are disclosed which require clamping to the rail resulting in a structure which is readily susceptible to damage and to being lost for reasons noted above.

SUMMARY

According to one aspect of the present invention there is provided a railway indicator device for a railway track, the device comprising:

a post for insertion into the ground;

a swing arm pivotally supported on the post; and an indicator panel supported on the swing arm for pivotal movement with the swing arm relative to the post between a raised position above the post and a lowered position spaced laterally from the post above the railway track.

According to a second aspect of the present invention there is provided a method of indicating on a railway track, the method comprising:

providing an indicator device comprising a post, a swing arm pivotally supported on the post and an indicator panel supported on the swing arm for pivotal movement with the swing arm relative to the post;

inserting the post into the ground laterally spaced from the railway track;

and pivoting the indicator panel together with the swing arm between a raised position above the post to a lowered position spaced laterally from the post above the railway track when indicating a condition associated with the railway track.

The use of a post which is fixed in the ground adjacent a railway track with the indicator panel being supported on a swing arm results in an ergonomic design which can be easily retracted and deployed with one hand. There is no longer a need to search for lost indicators as the indicator panel remains in place always ready for use by simple pivoting action. Accordingly there is no need to carry flags and blue lights as the indicator of the present invention is always located in proper place and can include a blue light hanging from an integral hook as desired. The pivot location of the swing arm on the post can be located several feet above the ground and accordingly the indicator panel is not susceptible to being lost in the snow as in conventional folding blue flag designs. Storage of the indicator panel in a vertical position above the post ensures that the indicator panel is well above the dirt and grime area adjacent the track and therefore requires much less cleaning.

The indicator panel is preferably positioned above the swing arm in the lowered position.

Stops are preferably located on the device for limiting pivotal movement of the swing arm beyond either of the raised or lowered positions.

The indicator panel may comprise a blue flag.

There may be provided a locking pin received through cooperating apertures in the post and swing arm for retaining the swing arm in a raised vertical orientation.

The swing arm is preferably longer than the post extends above ground.

The post extends may extend more than three feet above ground and preferably extends above ground approximately four feet.

The post is preferably spaced outwardly from the railway track a prescribed distance of several feet similarly to posts for other railway devices.

The indicator panel is preferably located directly above the railway track in the lowered position. The flag may be located off-centre above the railway track so as to be located directly above a rail of the railway track which is nearest to the post for minimising the required length of the swing arm.

The post is preferably inserted into the ground by forming a hole in the ground using a water drill and inserting the post into the hole formed in the ground.

BRIEF DESCRIPTION OF THE DRAWINGS

In the accompanying drawings, which illustrate an exemplary embodiment of the present invention.

DETAILED DESCRIPTION

Figure 1:
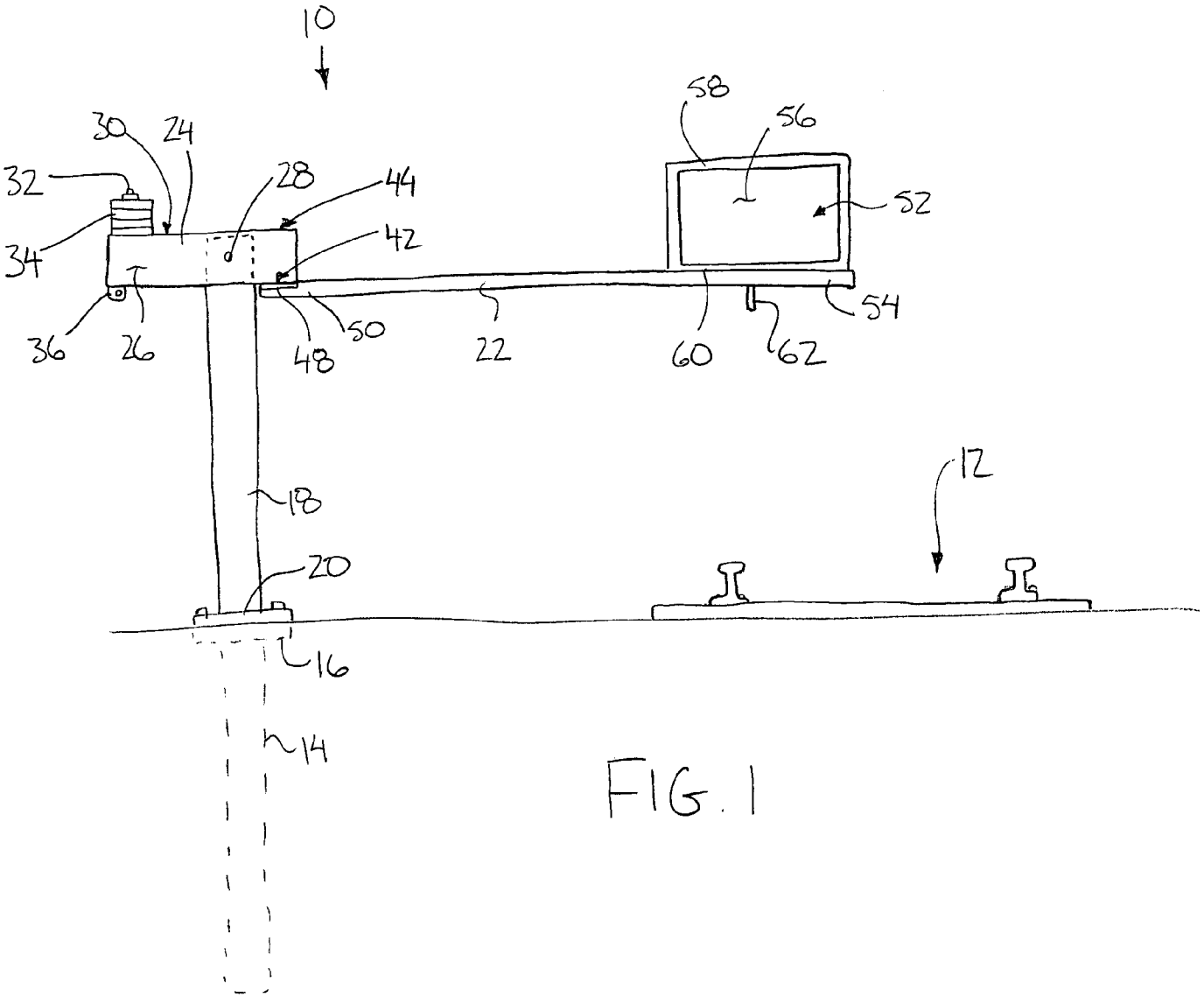
FIG. 1 is a schematic side elevational view of the indicator device supported in the ground adjacent a railroad track.

Referring to the accompanying drawings, there is illustrated a railway indicator device generally indicated by reference numeral 10. The device 10 is suited for providing indications associated with a railway track 12, and more particularly is suited for use as a blue flag for indicating that work is being done on rail equipment located on a particular section of track.

The device includes an upright post having a base section 14 which is suitably arranged for penetration into the ground. A mounting plate 16 is supported at a top end of the base section 14 and includes suitable mounting apertures therein for connection to a main post section 18 supported above ground. At a bottom end of the main post section 18 a mounting plate 20 is similarly provided having bolt holes therein for alignment with corresponding apertures in the base section 14. Threaded fasteners connect the main post section with the base section. The main post section has a square cross section and extends vertically above ground a distance in the order of approximately four feet.

A swing arm 22 is pivotally supported at a top end of the main post section 18. A pivot member 24 mounts the swing arm 22 pivotally on the post. The pivot member 24 includes two side plates 26 which are parallel and spaced apart from one another on opposing sides of the post. A pivot pin 28 spans between the plates 26 through the post for rotation of the swing arm and pivot member about a horizontal axis of the pin lying parallel to the rails of the track. Suitable spacers may be mounted about the pivot pin 28 between the post and each side plate to maintain proper spacing therebetween.

A vertical stop plate 30 spans between the side plates 26 adjacent the bottom end thereof when the plates are in an upright orientation along side the post. The stop plate 30 engages one side of the post when the side plates are in a vertical orientation so that pivotal movement from the vertical position of the plates is only permitted downwardly in one direction towards the track as the stop plate 30 spans the side plates on an opposing side of the post from the track.

Carrier bolts 32 project outwardly from the stop plate 30 for supporting a plurality of weighted plates 34 having apertures therein which span between the pair of bolts 32. Threaded nuts secured to the ends of the bolts permit the number of plates 34 to be adjustably secured therein to match weight of the swing arm 22 supported on the pivot member 24 on an opposing side of the post. The carrier bolts 32 and counter weight plates 34 supported thereon are spaced below the pivot pin 28 when the side plates are in a vertical orientation.

Each side plate includes a protrusion 36 projecting outwardly from the post in a common direction opposite the stop plate 30. Apertures are provided in the protrusions 36 which are aligned with one another for receiving a locking pin 38 slidably therethrough. The holes in the protrusion are located directly adjacent a common side of the post facing the track opposite the stop plate 30 so that the locking pin 38 received across the protrusions 36 spans the front side of the post facing the track to restrict downward pivotal movement of the swing arm 22 towards the track when the pin is received through the protrusions. The holes and protrusions within which they are formed are spaced below the pivot. The locking pin 38 is secured to the pivot member 34 by an elongate flexible chain 40 to prevent the pin from being lost.

The pivot member 24 also includes a front plate 42 and a back plate 44 adjacent the top end of the side plates when the side plates are in a vertical orientation. Each of the front and back plates span between the side plates at respective front and back sides of the post spaced above the pivot and the top end of the post. The front plate 42 includes a bottom edge 46 which is vertically spaced above the pivot a distance which is approximately equal to the space between the pivot and the front of the post such that the bottom edge 46 engages the front side of the post when the arm is pivoted downwardly into a horizontal position with the pivot member. In this configuration the swing arm is only permitted to pivot ninety degrees between the stops of the pivot member which engage opposing sides of the post.

The front plate 42 has a bracket 48 formed thereon which supports an inner end 50 of the swing arm thereon using threaded fasteners. Similarly an indicator panel 52 is mounted on the outer free end 54 of the swing arm also using threaded fasteners. The indicator panel 52 comprises a stiff panel which is rectangular in shape and permits some slight flexing or bending under the force of the wind blowing past the device. The panel includes a main rectangular area 56 which is blue and is surrounded by a peripheral band of white reflective material 58. The panel is bolted along its bottom edge 60 when the swing arm is in a horizontal lowered position. Accordingly the panel 52 extends upwardly from the arm when the arm is horizontal. Flexing movement of the panel at an upper free end thereof as a result of wind causes the panel to be urged downwardly for engagement of the bottom edge 46 of the front plate 42 of the pivot member to engage against the front face of the post and thereby maintain the arm and panel in a lowered horizontal position.

A hook 62 is supported on the swing arm adjacent the indicator panel 52 which is suitable for suspending a portable blue light therefrom.

In order to use the indicator device, the base section of the post is first inserted into the ground by forming a hole in the earth using a water pressure drill to prevent damage to underground wires or pipes and the like. The post is mounted at a prescribed spacing of several feet laterally outwardly from a track. The spacing from the track is comparable to spacing of posts for other railway equipment. Once the base section is secured in the ground, the main post section is bolted thereto to extend above ground with the pivot pin being located at a top end of the post approximately four feet above ground.

Figure 2:
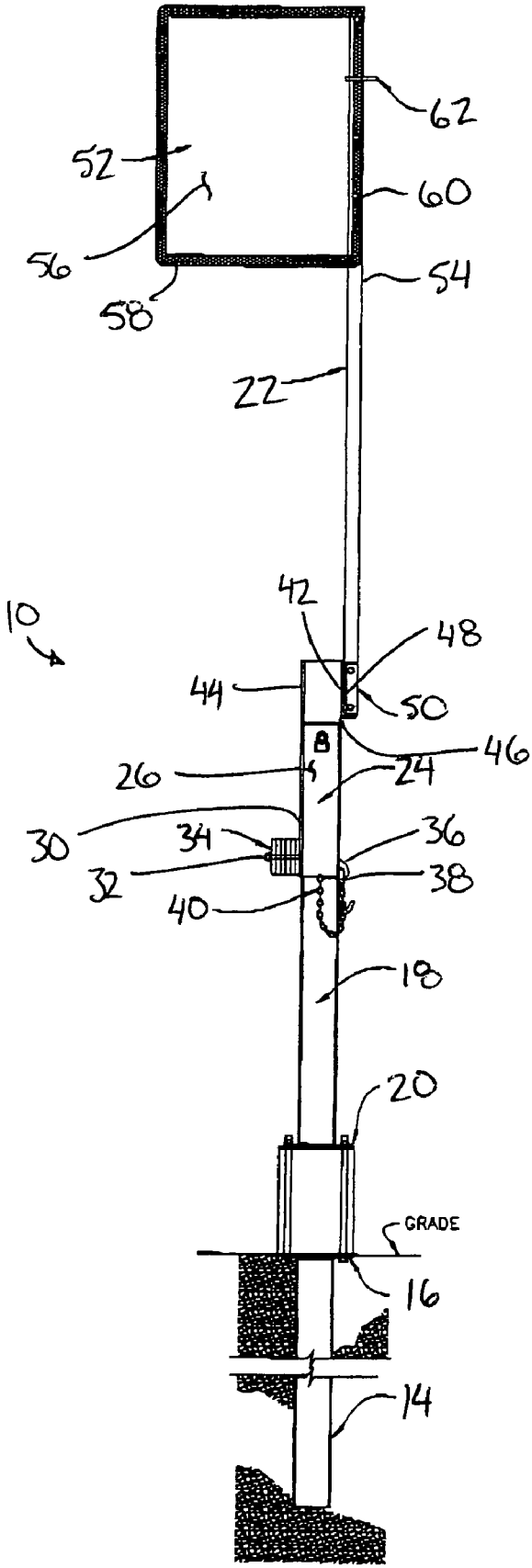
FIG. 2 is a side elevational view of the device in a raised position.
Figure 3:
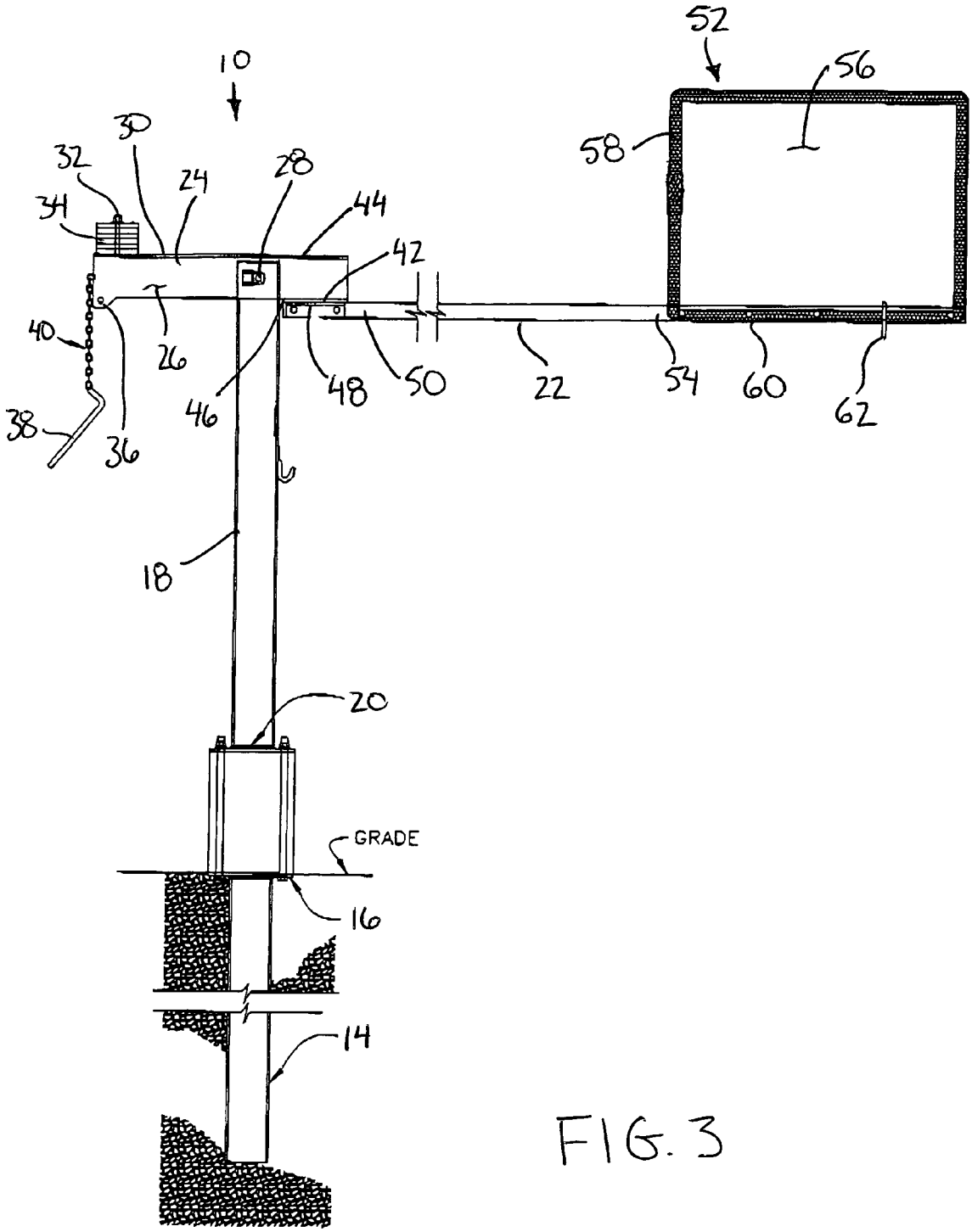
FIG. 3 is a side elevational view of the device in a lowered position.
Figure 4:
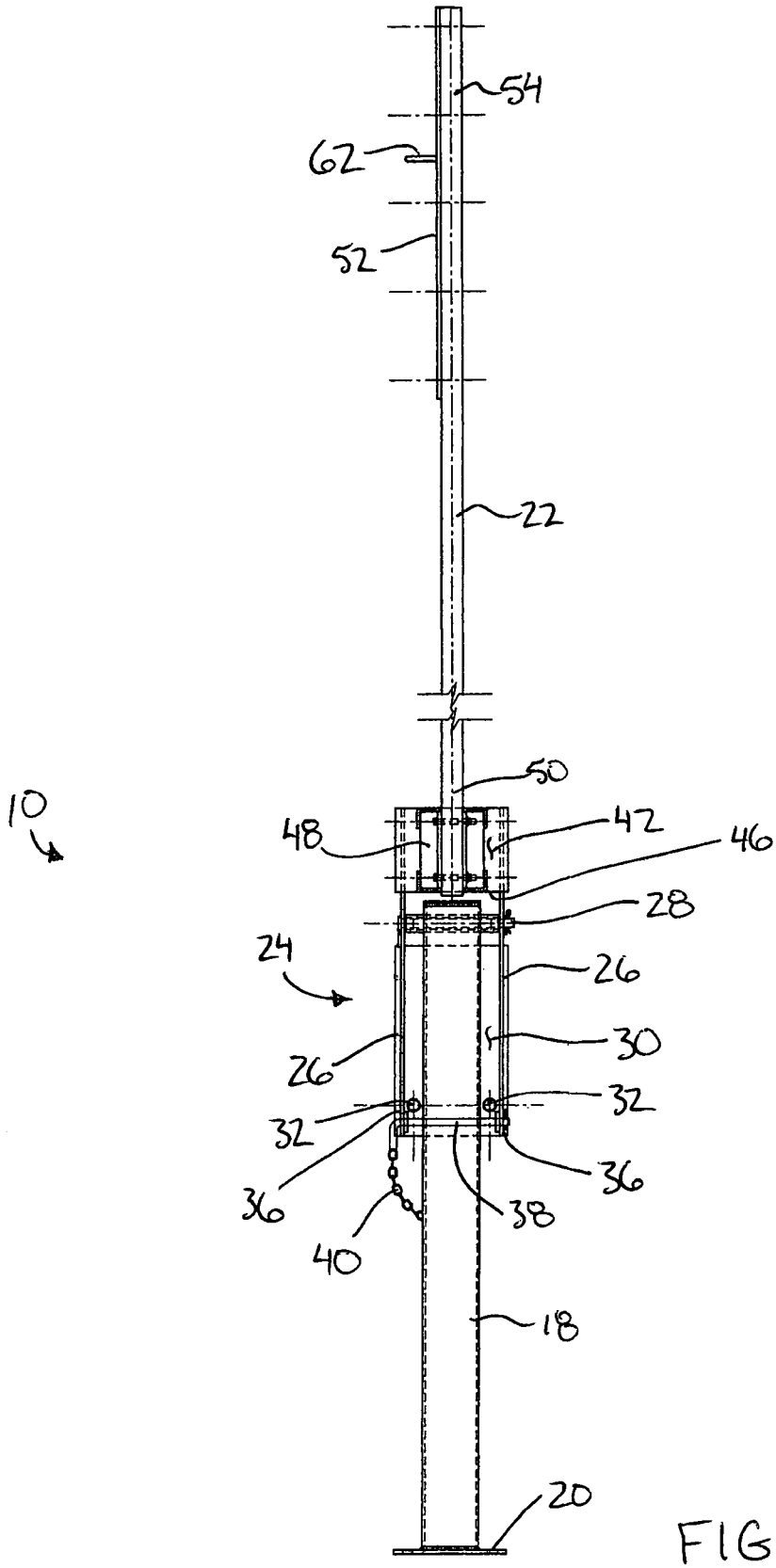
FIGS. 4 and 5 are front and rear elevational views respectively of the device in a raised position.
Figure 5:
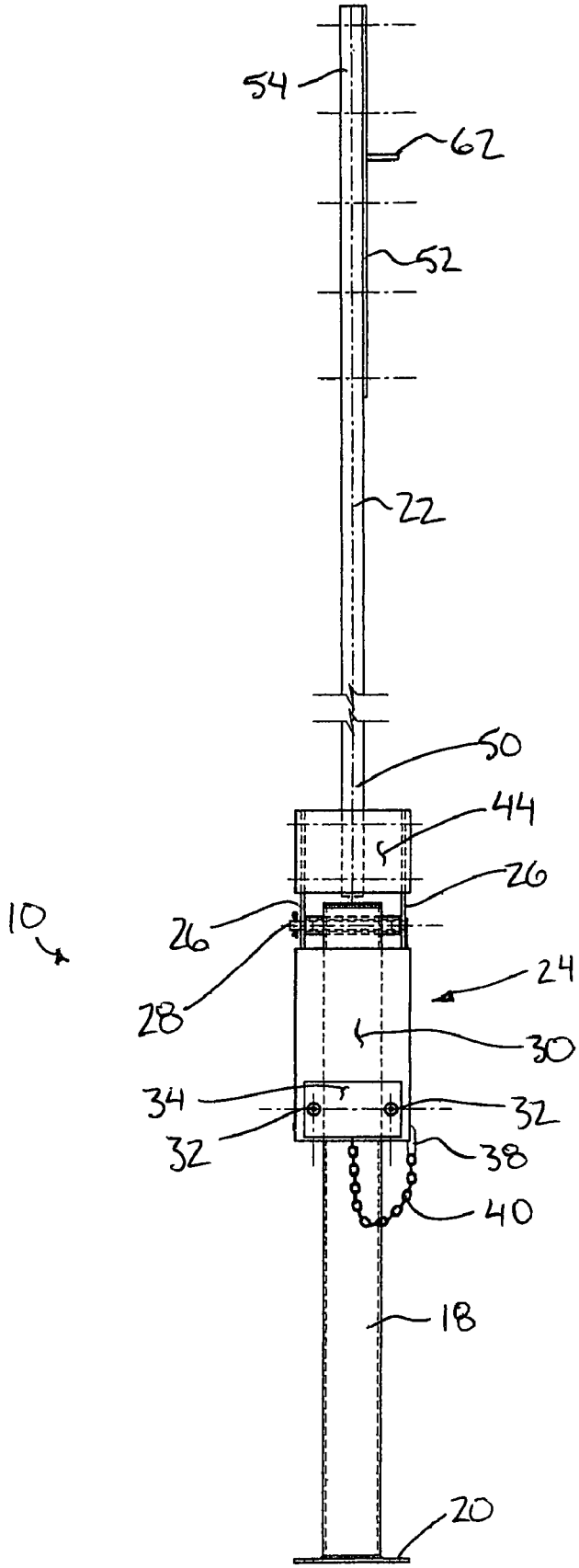
Figure 6:
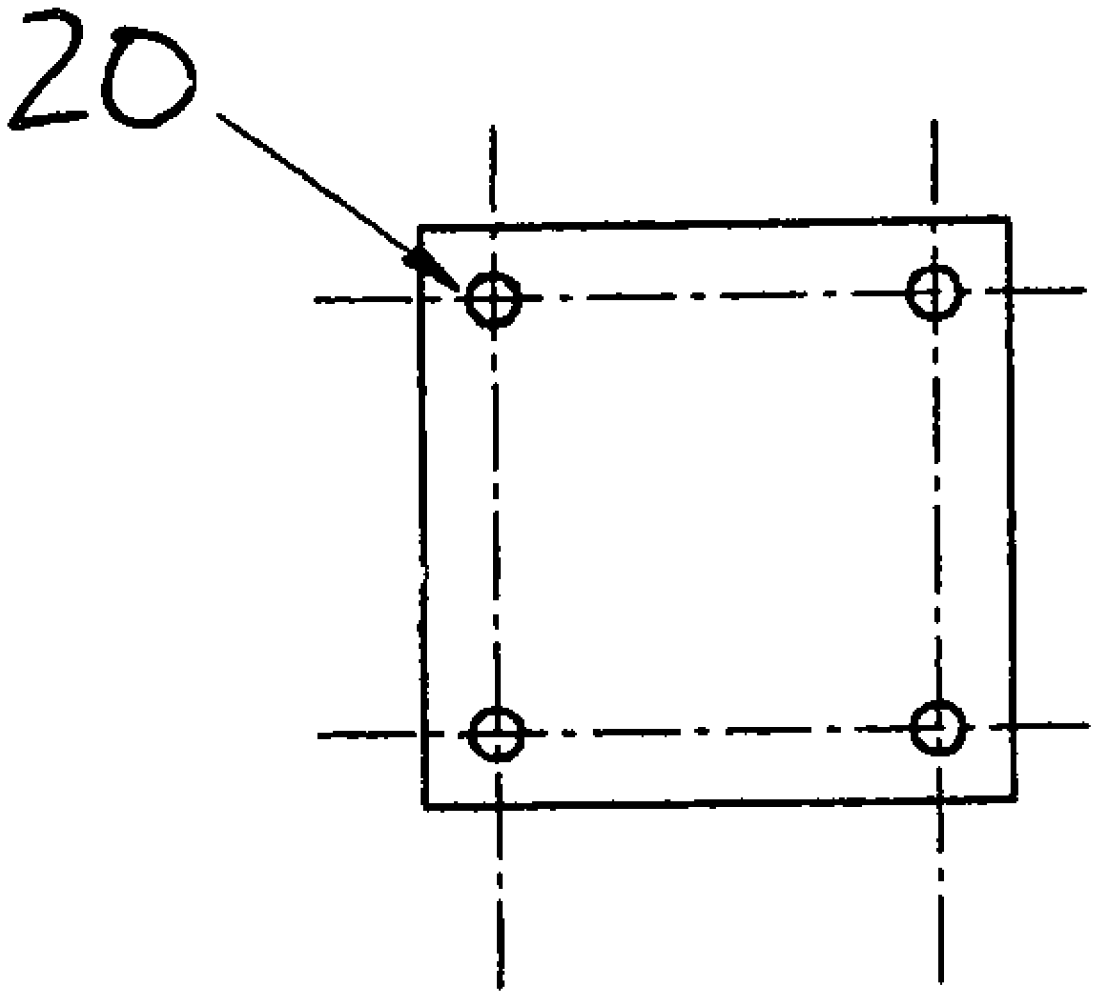
FIG. 6 is a bottom plan view of the base of the main section of the post.

Under normal conditions, the swing arm is secured-in a raised vertical orientation as illustrated in the raised position of FIGS. 2, 4 and 5 in which the locking pin retains the pivot member in the vertical orientation. When indicating a condition is desired, the pivot pin is removed and the swing arm is lowered into the horizontal position. The counter balance plates on the pivot member 24 are adjusted such that weight of the swing arm on one side of the pivot is approximately equal to or slightly greater than weight of the plates 34 on the pivot member diametrically opposite the swing arm. The post is located a safe prescribed distance from the rails of the track with the swing arm being longer between the pivot point and the indicator panel then height of the post from the ground to the pivot point for optimal location of the panel in the lowered position of the swing arm. Ideally the panel is located directly above the rails of the track, offset to one side so as to be above a nearest one of the rails of the track from the post.

While one embodiment of the present invention has been described in the foregoing, it is to be understood that other embodiments are possible within the scope of the invention. The invention is to be considered limited solely by the scope of the appended claims.

The invention claimed is:

1. A railway indicator device in combination with a railway track, the device comprising:

a post inserted into the ground spaced laterally outward from the railway track;

a swing arm pivotally supported on the post; and an indicator panel supported on the swing arm for pivotal movement with the swing arm relative to the post between a raised position above the post and a lowered position spaced laterally from the post directly above the railway track.

2. The device according to claim 1 wherein the indicator panel is positioned above the swing arm in the lowered position and is formed of flexible material for flexing under force of wind.

3. The device according to claim 1 wherein there is provided stops limiting pivotal movement of the swing arm beyond either of the raised or lowered positions.

4. The device according to claim 1 wherein the indicator panel comprises a blue flag.

5. The device according to claim 1 wherein there is provided a locking pin received through cooperating apertures in the post and swing arm for retaining the swing arm in a raised vertical orientation.

6. The device according to claim 1 wherein the swing arm is longer than the post extends above ground.

7. The device according to claim 1 wherein the post extends more than three feet above ground.

8. The device according to claim 4 wherein the flag is off-centre above the railway track so as to be located directly above a rail of the railway track which is nearest to the post.

9. The device according to claim 1 wherein the swing arm is pivotal about an axis oriented substantially parallel to rails of the railway track.

10. A method of indicating on a railway track, the method comprising:

providing an indicator device comprising a post, a swing arm pivotally supported on the post and an indicator panel supported on the swing arm for pivotal movement with the swing arm relative to the post;

inserting the post into the ground laterally spaced from the railway track;

and pivoting the indicator panel together with the swing arm between a raised position above the post to a lowered position spaced laterally from the post directly above the railway track when indicating a condition associated with the railway track.

11. The method according to claim 10 including forming the indicator panel of flexible material and locating the indicator panel to span upwardly from the swing arm in the lowered position.

12. The method according to claim 10 including forming stops on the swing arm which limits pivotal movement beyond the lowered and raised positions.

13. The method according to claim 10 wherein the indicator panel comprises a blue flag.

14. The method according to claim 10 including inserting a locking pin through cooperating apertures in the swing arm and the post in the raised position.

15. The method according to claim 10 including providing the swing arm to be longer than the post extends above ground.

16. The method according to claim 10 including pivotally supporting the swing arm on the post more than three feet above ground.

17. The method according to claim 10 including supporting the post in the ground at a prescribed spacing from the railway track.

18. The method according to claim 10 including locating the indicator panel in the lowered position directly above one of the rails of the railway track which is nearest to the post.

19. The method according to claim 10 including inserting the post into the ground by forming a hole in the ground using a water drill and inserting the post into the hole formed in the ground.

* * * * *